United States Patent [19]

Creighton

[11] Patent Number: 4,644,963

[45] Date of Patent: Feb. 24, 1987

[54] SMOKING ARTICLES

[75] Inventor: David E. Creighton, Southampton, England

[73] Assignee: British-American Tobacco Company Limited, London, England

[21] Appl. No.: 731,465

[22] Filed: May 7, 1985

[30] Foreign Application Priority Data

May 19, 1984 [GB] United Kingdom ..... 8412867

[51] Int. Cl.[4] ..... A24D 3/04

[52] U.S. Cl. ..... 131/336

[58] Field of Search ..... 131/336

[56] References Cited

U.S. PATENT DOCUMENTS 4,232,574 11/1980 Hall ..... 131/336

*Primary Examiner*—V. Millin

*Attorney, Agent, or Firm*—Kane, Dalsimer, Kane Sullivan and Kurucz

[57] ABSTRACT

A cigarette comprises a mouthpiece attached to a cigarette rod by a wrapper which bounds a ventilation air chamber of the mouthpiece. One or more orifices intercommunicate the air chamber with a smoke passage of the mouthpiece. The orifice(s), rather than the air flow impedance of the wrapper controls the degree of ventilation of the mouthpiece.

9 Claims, 2 Drawing Figures

SMOKING ARTICLES

Figure 1:
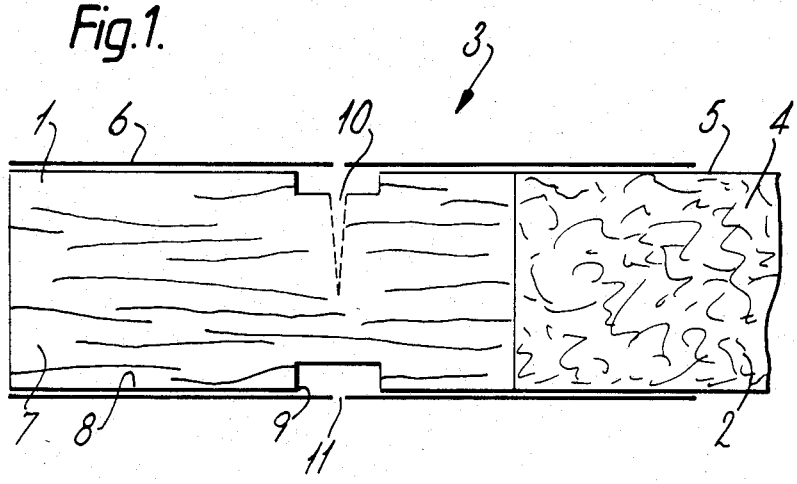

This invention relates to smoking articles, cigarettes for example, comprising ventilated mouthpieces.

Cigarettes are commonly provided with a filter and ventilation means permitting ambient air to be drawn into the filter. The ventilation means often comprises a ring or zone of macro or micro perforations in a tipping wrapper overlying the filter. The ventilation air serves to dilute tobacco smoke drawn from the cigarette rod, the ratio of smoke to air of the smoke/air mixture issuing from the mouth end of the filter being governed by the relative gas flow impedances of the ventilation perforations and of that portion of the filter upstream of the perforations. If the filter comprises a plugwrap, it will present a further gas flow impedance, usually of a low order, in series with that of the ventilation perforations. Thus for a given filter comprising high permeability plugwrap, the smoke to air ratio is governed by the gas flow impedance presented by the ring or zone of ventilation perforations extending around the filter.

It is an object of the present invention to make possible the provision of a smoking article comprising a ventilated mouthpiece, wherein the degree of ventilation at the mouthpiece is substantially controlled by other than the air flow impedance of an exterior wrapping of the article.

The present invention provides a smoking article comprising a smoking material rod, a mouthpiece attached to said rod, and a wrapper extending about said mouthpiece at least at a location spaced from the mouth end of said mouthpiece and said wrapper being highly air permeable at said location, said mouthpiece comprising a smoke passage extending through said element to the mouth end of said mouthpiece, and said mouthpiece further comprising a ventilation air chamber bounded by said wrapper at said location, the walls of said chamber being air impermeable except for orifice means extending therethrough, which orifice means provides an air-flow communication, having a cross-sectional area within a range of 0.2 $mm^2$ to 0.8 $mm^2$, between the interior of said chamber and said smoke passage.

The mouthpiece may take the form of a filter, in which case it may comprise one or more cylindrical plugs of filtration material. In an alternative embodiment, the mouthpiece may take the general form of a hollow tube.

At the portion of the smoke passage at which the orifice means communicates with the smoke passage, the smoke passage may be defined by filtration material, fibrous material for example, as well as by peripheral boundary wall means of the mouthpiece. Alternatively, at this portion the smoke passage may be empty of filtration on other material and thus be defined solely by the peripheral wall means.

The wrapper may be a tipping wrapper which serves to attach the mouthpiece to the smoking material rod. The wrapper may be inherently air permeable or may be provided with ventilation perforations at the said location.

Suitably, the ventilation air chamber is provided by a groove which extends, preferably continuously, about the mouthpiece. The orifice means is advantageously provided by one to six orifices, preferably not more than four. If a plurality of orifices is provided, the cross-sectional area of each orifice should be within the range of 0.2 $mm^2$ to 0.8 $mm^2$.

It is important that the gas flow impedance of the wrapper at the said location is low in comparison with that of the orifice(s), as this ensures that the degree of ventilation is controlled substantially by the orifice(s) and not by the wrapper. Thus the air permeability of the wrapper at the said location should be at least 1000 Coresta units say, preferably at least 2000 Coresta units, and more preferably at least 3000 Coresta units.

The overall degree of ventilation, i.e. that associated with the mouthpiece and that associated with the smoking material rod, should not be less than 30% and should preferably be at least 60%.

In order that the invention may be clearly understood and readily carried into effect, reference will now be made, by way of example, to the accompanying diagrammatic drawings, FIG. 1 of which shows, in axial section, a mouthpiece in the form of a filter and part of a tobacco rod of a cigarette, and FIG. 2 of which shows, in axial section, a mouthpiece element.

Tobacco rod 2 of smoking article 3 of FIG. 1 comprises a tobacco filler 4 which may, for example, be a blend of flue-cured tobaccos or be of the so-called U.S. blended type. The filler 4 is wrapped in a cigarette paper 5. Filter 1 is attached to the tobacco rod 2 by a tipping wrapper 6.

The filter 1 comprises a cylindrical plug 7 of fibrous filtration material, cellulose acetate for example, and a plugwrap 8. At a location remote from the mouth end of the filter 1, the plug 7 is provided with an annular peripheral groove 9 of rectangular section providing a ventilation air chamber. The groove 9 may be, for example, 3 mm wide.

The walls of the groove 9 are air impermeable, or of low air permeability, and may be so rendered by the application thereto of a sealant material. An alternative is to employ as plugwrap 8 a paper having a content of thermoplastic material and to mould the groove 9 thermally. As a result, the plugwrap 8 sealingly lines the walls of the finished groove 9.

Preferably, the portions of the plugwrap 8 extending at each side of the groove 9 are of zero or low gas permeability.

There is formed in the base of the groove 9 a single orifice 10, which may be, for example, 0.7 mm diameter. The orifice 10 provides an air-flow communication between the groove 9 and the interior of the plug 7 of filtration material. At a location of the tipping wrapper 6 overlying the groove 9, the tipping wrapper is provided with a ring of ventilation perforations 11. The air flow impedance presented by the ring of perforations is very low compared with that of the orifice 10. Thus the degree of ventilation attributable to the filter 1 is controlled by the orifice 10 rather than by the perforations 11.

The orifice 10 may be formed subsequent to the formation of the groove 9, in which case the orifice 10 is suitably formed mechanically or by use of a laser. In either such case the air flow communication provided by the orifice 10 may be continued for some distance into the plug 7, this being indicated by broken lines in FIG. 1. An alternative method of providing the orifice 10 would be to use a plugwrap with a pre-formed hole therein.

Although as above described, the filter 1 comprises only one orifice in the groove 9, a plurality of orifices, preferably not more than four, could be provided, these being suitably disposed equiangularly about the groove 9. If a plurality of orifices is to be incorporated in the filter, the total cross-sectional area thereof should be in the range of 0.2 $mm^2$ to 0.8 $mm^2$.

If the groove 9 is a deep groove, that is to say if it is of a depth of 2.5 mm or more with a plug 7 diameter of 8 mm, there may be a tendency for solid phase smoke components to be deposited at the upstream end of the constriction in the smoke passage which the deep groove presents. In an extreme case, the solid phase deposits may cause a significant blocking of the smoke passage. Such blocking can be obviated by the simple expedient of positioning the orifice, or preferably orifices, at the upstream end of the groove 9, i.e. to the right as viewing FIG. 1.

Figure 2:
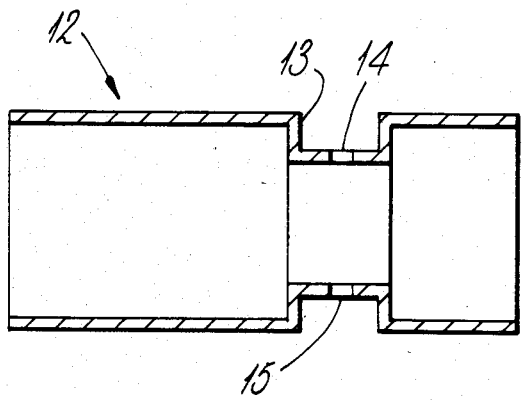

Mouthpiece element 12 of FIG. 2 is formed of a rigid plastics material and takes the general form of a thin-walled hollow tube provided with an annular peripheral groove 13. Two orifices 14, 15 extend through that portion of the wall of the element 12 forming the base of the groove 13. As is indicated in FIG. 2, the orifices 14, 15 are disposed diametrically opposite each other. The mouthpiece element 12 may be utilised in a manner similar to that of the filter 1 of smoking article 3. That is to say, the element 12 may be attached to a tobacco rod (not shown) by a tipping wrapper (also not shown), which tipping wrapper is highly air permeable at least in that zone thereof which overlies the groove 13, so that the degree of ventilation is determined by the orifices 14, 15. If required, filtration material may be disposed within the element 12, although preferably not within the smoke passage restriction formed by the groove 13. Alternatively, a cylindrical plug of filtration material may be placed at the mouth end of the element 12 when the element 12 is incorporated in a cigarette. The element 12, instead of being of unitary construction, could be provided by placing in abutment a number of sub-assemblies.

What is claimed is:

1. A smoking article comprising a smoking material rod, a mouthpiece attached to said rod, and a wrapper extending about said mouthpiece at least at a location spaced from the mouth end of said mouthpiece and said wrapper being highly air permeable at said location, said mouthpiece comprising a smoke passage extending through said element to the mouth end of said mouthpiece, and said mouthpiece further comprising a ventilation air chamber bounded by said wrapper at said location, the walls of said chamber being air impermeable except for orifice means extending therethrough, which orifice means provides an air-flow communication, having a cross-sectional area within a range of 0.2 $mm^2$ to 0.8 $mm^2$, between the interior of said chamber and said smoke passage, said orifice substantially controlling the degree of ventilation of the mouthpiece.

2. A smoking article as claimed in claim 1, wherein said ventilation air chamber is in the form of a groove which extends about said mouthpiece.

3. A smoking article as claimed in claim 1, wherein said orifice means is a single orifice.

4. A smoking article as claimed in claim 1, wherein said orifice means is provided by a plurality, not exceeding six, of orifices, each of said orifices being of a cross-sectional area within a range of 0.2 $mm^2$ to 0.8 $mm^2$.

5. A smoking article as claimed in claim 4, wherein the number of said orifices does not exceed four.

6. A smoking article as claimed in claim 1, wherein at the portion of said smoke passage at which said orifice means communicates with said smoke passage, said smoke passage is defined solely by a peripheral boundary wall.

7. A smoking article as claimed in claim 1, wherein at the portion of said smoke passage at which said orifice means communicates with said smoke passage, said smoke passage is defined by a peripheral boundary wall and by filtration material disposed in said smoke passage.

8. A smoking article as claimed in claim 1, wherein the air permeability of said wrapper at said location is at least 1000 Coresta units.

9. A smoking article as claimed in claim 1, wherein the overall degree of ventilation is at least 30%.

* * * * *